US010126077B1

(12) United States Patent
Glover

(10) Patent No.: US 10,126,077 B1
(45) Date of Patent: Nov. 13, 2018

(54) CARTRIDGE MAGAZINE LOADER

(71) Applicant: Bronson Glover, Harrah, OK (US)

(72) Inventor: Bronson Glover, Harrah, OK (US)

( * ) Notice: Subject to any disclaimer, the term of this patent is extended or adjusted under 35 U.S.C. 154(b) by 0 days.

(21) Appl. No.: 15/998,008

(22) Filed: Jun. 8, 2018

(51) Int. Cl.
*F41A 9/82* (2006.01)
*F41A 9/83* (2006.01)

(52) U.S. Cl.
CPC ..... *F41A 9/83* (2013.01)

(58) Field of Classification Search
CPC ..... F41A 9/82; F41A 9/83
See application file for complete search history.

(56) References Cited

U.S. PATENT DOCUMENTS 2,834,137 A * 5/1958 Kunz ..... F41A 9/83 42/87
4,574,511 A 3/1986 Csonger
4,689,909 A 9/1987 Howard
4,706,402 A 11/1987 Csonger
4,719,715 A 1/1988 Howard
5,355,606 A * 10/1994 Origoni ..... F41A 9/83 42/87
6,754,987 B1 * 6/2004 Cheng ..... F41A 9/83 42/87
7,866,080 B2 1/2011 Tucker
8,650,792 B1 2/2014 Overmars
9,347,722 B1 5/2016 Morris
9,772,152 B1 * 9/2017 Niccum ..... F41A 9/83
2014/0311008 A1 * 10/2014 McPhee ..... F41A 9/84 42/87
2017/0211902 A1 * 7/2017 Mills ..... F41A 9/83

* cited by examiner

*Primary Examiner* — Gabriel J. Klein
(74) *Attorney, Agent, or Firm* — Randal Homburg

(57) ABSTRACT

A loading device to allow for a quick charging of a magazine with cartridges adapted to be attached to the top of a magazine for a certain caliber of firearm with base member defining an insert portion receiving a stack of cartridges and a push member engaging the base member to force the stack of cartridges into the magazine in a singular downward movement, the loading device also receiving and storing a stack of cartridges within additional base members for quick loading of the firearm subsequent to emptying a magazine.

3 Claims, 9 Drawing Sheets

Fig. 5
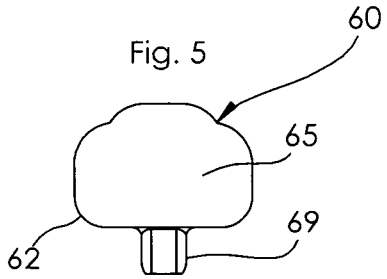
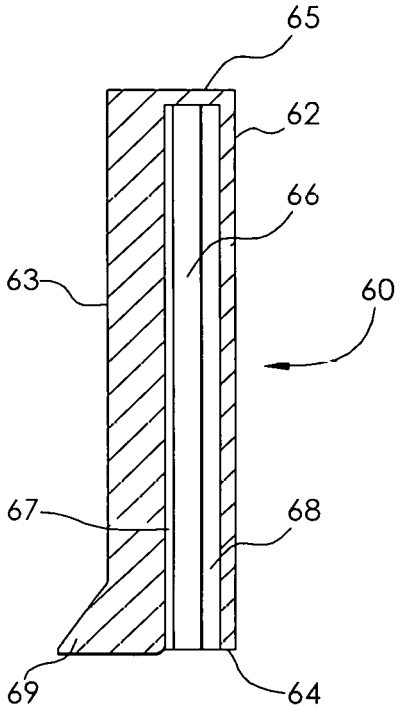
Fig. 7
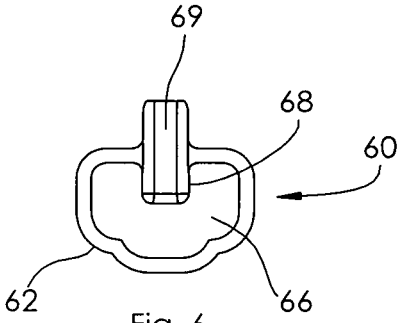
Fig. 6

CARTRIDGE MAGAZINE LOADER

CROSS REFERENCE TO RELATED APPLICATIONS

None.

I. BACKGROUND OF THE INVENTION

1. Field of Invention

A loading device to allow for a quick charging of a magazine with cartridges adapted to be attached to the top of a magazine for a certain caliber of firearm with base member defining a magazine receiver receiving a stack of cartridges and a push member engaging the base member to force the stack of cartridges into the magazine in a singular downward movement, the loading device also receiving and storing a stack of cartridges within additional base members for quick loading of the firearm subsequent to emptying a magazine.

2. Description of Prior Art

A preliminary review of prior art patents was conducted by the applicant which reveal prior art patents in a similar field or having similar use. However, the prior art inventions do not disclose the same or similar elements as the present magazine loader, nor do they present the material components in a manner contemplated or anticipated in the prior art.

Several prior art devices provide for a magazine loader that installs upon a magazine and provides a depression means to quickly load a single bullet into the magazine of a handgun by overcoming the upward tension of the magazine spring for rapid insertion of several bullets in series into the magazine. These devices include U.S. Pat. No. 9,347,722 to Morris, which is a stand and a hydraulic shaft which forces each bullet into the magazine per depression of the hydraulic shaft, U.S. Pat. No. 8,650,792 to Overmars, which is a two pronged handpiece that provides a slide for each bullet to install within the magazine, U.S. Pat. No. 5,355,606 to Origoni, which engages the magazine and provides for a springed actuator to force each bullet into the magazine to create an opening for the insertion of the next bullet into the magazine, U.S. Pat. No. 4,719,715 to Howard, which performs the same function as does Origoni, except for a different configuration of the actuator into a singular piston and forming a sleeve which inserts over the magazine, and U.S. Pat. No. 4,689,909 to Howard, which appears to be the same device as in Howard '715.

Devices which appear to install multiple bullets into a magazine using a singular stroke motion include U.S. Pat. No. 4,574,511 to Csonger, which discloses a sleeve receiving a plurality of stacked column of ammunition which is thrust into a magazine engaged within the sleeve, with each column forced into the magazine each time an actuator or plunger is forced into the sleeve to eliminate each column from the sleeve. Another multiple bullet installation device is shown in U.S. Pat. No. D815,235 to Grego, which shows a sleeve and a shaped insert which hold a stack of bullets in alignment while the shaped insert is pressed downward, forcing the stack of bullets within the sleeve into a magazine positioned below the sleeve. Another plunger device demonstrates the springed plunger upon a sleeve which forces a stack of bullets within the sleeve downward into a magazine engaged below the sleeve, as indicated in U.S. Pat. No. 4,706,402, also to Csonger.

II. SUMMARY OF THE INVENTION

Magazine loaders are used to quickly reload rifle or pistol magazines on semi-automatic and automatic weapons. These magazine loaders either assist in placing a single bullet or cartridge within a magazine until the magazine is loaded to a desired capacity or provide a means to load a stack of bullets or cartridge into the magazine using a single movement or a series of like movements. Sometimes, the magazine loaders have the capacity to store a stack of cartridges until such time as the firearm magazine is emptied, providing for a quick connection to the empty magazine and quick refilling of the magazine with the stored stack of cartridges.

The purpose of the present magazine loader is to provide for a quick loading of an empty magazine with a stack of cartridge and also to provide for storage of a stack of cartridges within the magazine loader until such time a firearm magazine is empty, with the magazine loader quickly applied to the empty magazine and the cartridges stored within the magazine loader are quickly installed within the empty magazine. Another purpose of the magazine loader is to supply the basic components in a simply mechanism comprising a base member, a push member and a lock member assembly from recycled plastic or other molded or polymeric layered material which is adapted to a specific caliber of cartridge and magazine. Yet another purpose of the magazine loader is to provide the base member with a variety of calibers and cartridge capacities which are suitable for a variety of caliber and cartridge capacity magazines.

III. DESCRIPTION OF THE DRAWINGS

The following drawings are submitted with this utility patent application.

FIG. 5 is a top view of the push member.

FIG. 6 is a bottom view of the push member.

FIG. 7 is a side sectional view of the push member.

IV. DESCRIPTION OF THE PREFERRED EMBODIMENT

Figure 1:
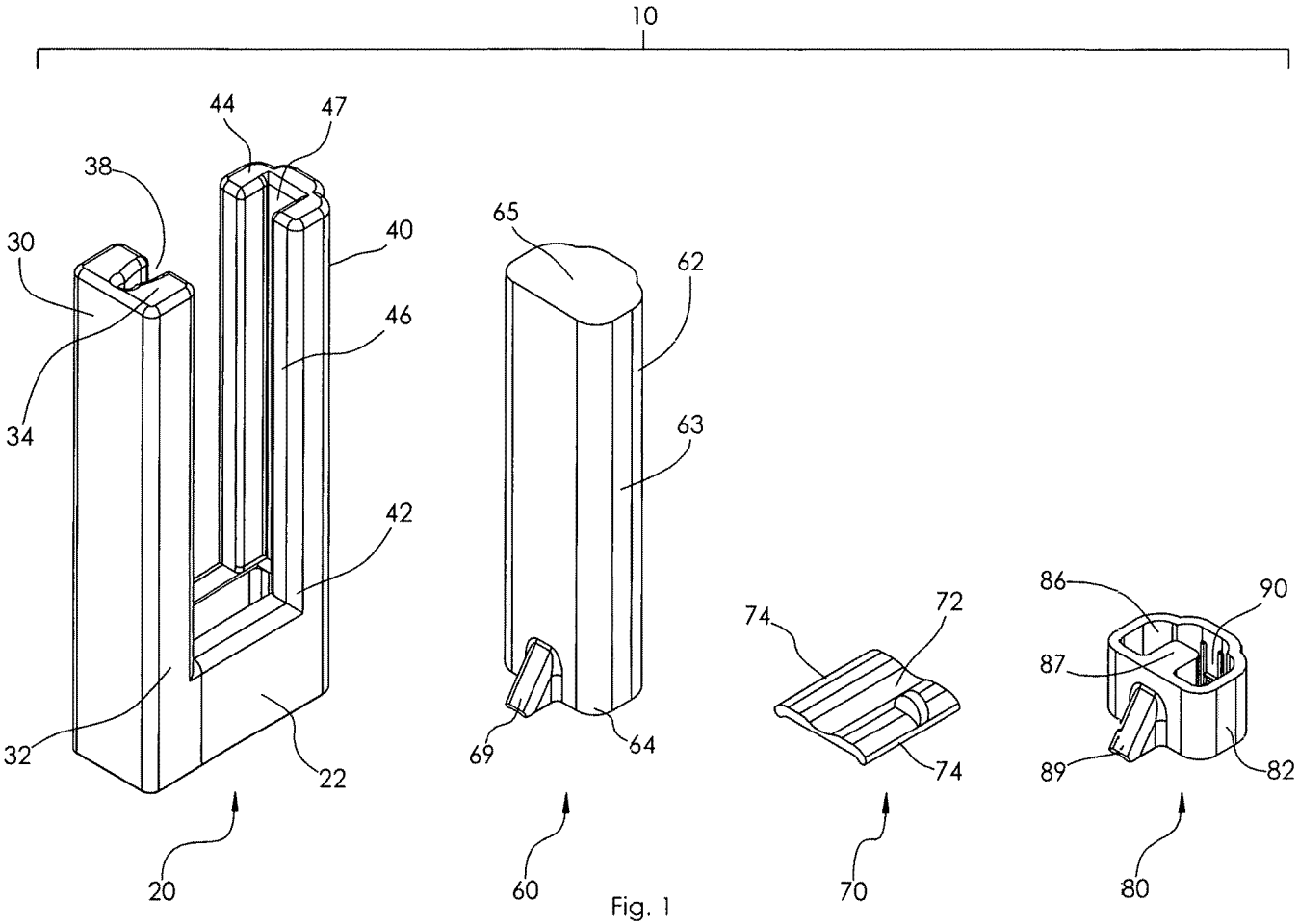
FIG. 1 is a view of the magazine loading device including the base member, the push member, the block member assembly and the pillar locking sleeve.
Figure 3:
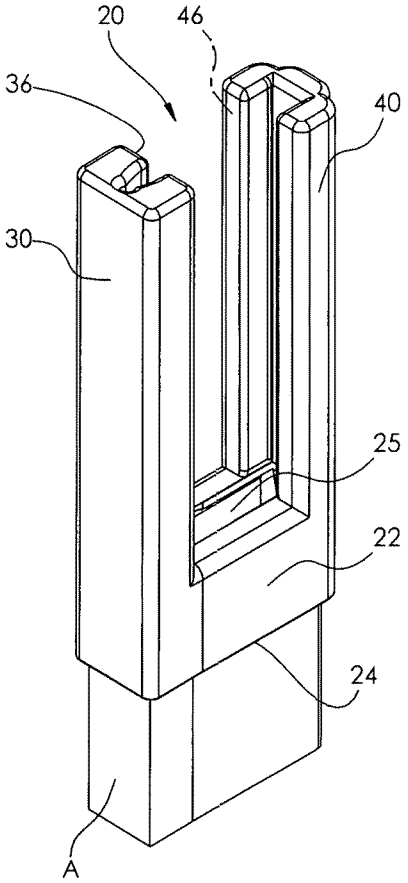
FIG. 3 is a perspective view of the base member and the rifle cartridge magazine in an engaged embodiment.
Figure 2:
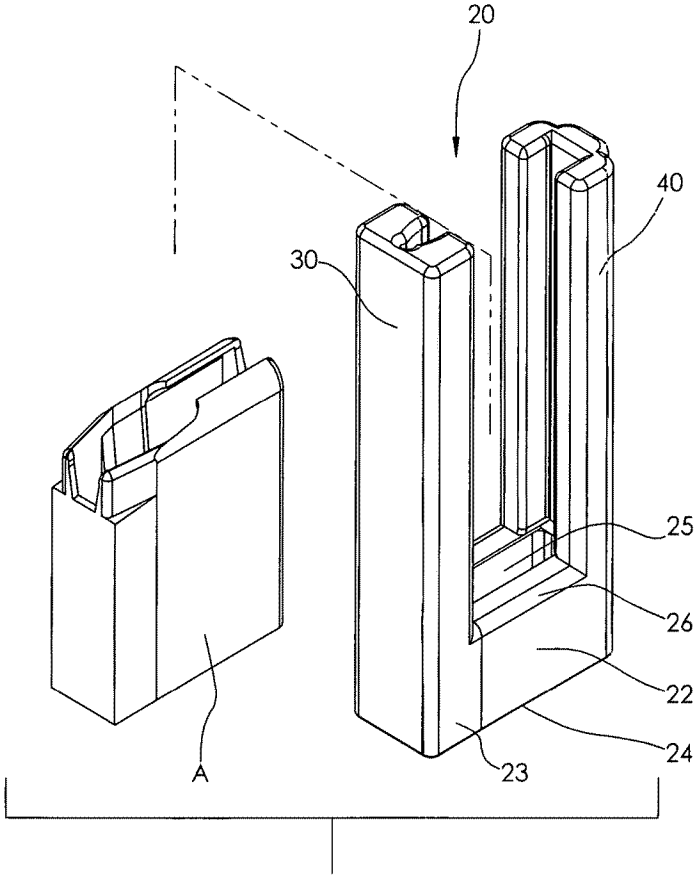
FIG. 2 is a perspective view of the base member and a rifle cartridge magazine.
Figure 4:
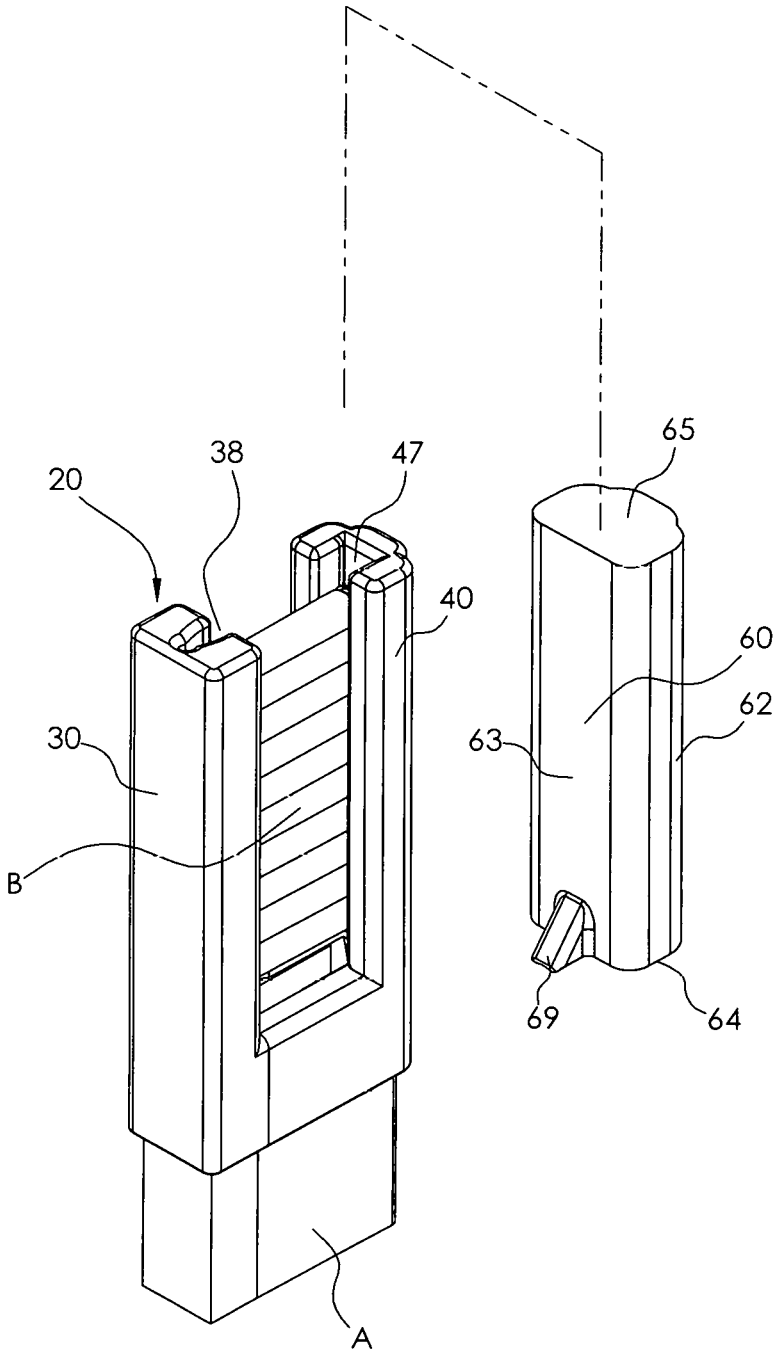
FIG. 4 is a perspective view of the base member and rifle cartridge in an engaged embodiment with a stack of cartridges within the base member showing the push member prior to installation upon the rear support member.

A magazine loading device 10 for quick loading a magazine A of a firearm, as shown in FIGS. 1-16 of the drawings, comprises a base member 20 defining a frame piece 22 having a lower portion 23 defining a magazine receiver 24 adapted to secure to an upper portion of a specific caliber magazine A of a rifle or other firearm and an upper end 26 defining a front support pillar 30 and a rear support pillar 40, the front support pillar 30 defining a uniform shape from a lower end 32 extending from the upper end 26 of the frame piece 22 to a terminal upper end 34, the front support pillar further defining an interior surface 36 providing an inward tapered slot 38 adapted to the shape of a bullet tip C of a same caliber cartridge B as utilized by the firearm to which the magazine receiver 24 is adapted, with the rear support member 40 defining a uniform shape from a lower end 42 extending from the upper end 26 of the frame piece 22 to a terminal upper end 44, the front support pillar 30 and rear support pillar 40 being parallel along their respective lengths. The rear support pillar 40 further defines an interior surface 46 providing a uniform width linear slot 47 adapted to the shape of a cartridge base D of the same caliber as utilized by the firearm to which the magazine receiver 24 and inward tapered slot 38 of the front support pillar 30 is adapted, and an outer surface 28 defining a column of evenly spaced lateral indentations 49 from the lower end 42 to the terminal upper end 44. The front support pillar 30 and rear support member 40, being parallel, may be straight and perpendicular from the frame piece 22, or they may be curved, retaining the parallel alignment of each support pillar. The frame piece 22 further includes a loading channel 25 which extends through the upper end 26 of the frame piece 22 to the lower portion 23 into the magazine receiver 24 and between the front support pillar 30 and the rear support pillar 40, FIGS. 2-4.

A push member 60, FIGS. 4-7, defines an outer surface 62 forming a grip portion 63, a lower end 64 and an upper end 65, and an inner vertical bore 66 defining an inner slot 67 adapted to slideably engage the rear support pillar 40 of the base member 20, the inner slot 67 extending a linear slot member 68 which slidably engages within the linear slot 47 of the rear pillar 40 along the length of the inner vertical bore 66 and an inner tab extension 69 extending inward from the lower end 64. When the push member 60 is engaged with the rear support pillar 40, it has the capacity to slide the entire length of the rear support pillar 40 with the lower end 64 being capable of contact with the upper end 26 of the frame piece 22, with the inner tab extension 69 directly positioned over the loading channel 25 of the base member 20.

Use of the base member 20 and the push member 60 to conduct the loading operation of the magazine A would include the steps comprising inserting an appropriate caliber magazine A within the magazine receiver 24 of the base member 20 in the appropriate direction with the front support pillar 30 oriented with the front of the magazine and the rear support pillar 40 oriented with the rear of the magazine, loading a stack of suitable cartridges B into the base member by placing the tip C of each cartridge B within the inward tapered slot 38 of the front support pillar 30 and the rear D of each cartridge B in the linear slot 47 of the rear pillar 40, placing the push member 60 upon the rear support pillar 40, and applying a downward force upon the outer surface 62 of the grip portion 63 of the push member 60 as the inner tab extension 69 exerts a force against the rear D of the uppermost cartridge B, forcing the entire stack of cartridges B through the loading channel 25 into the magazine B in a singular downward stroke motion. These steps are demonstrated in part in FIGS. 2-7.

Figure 8:
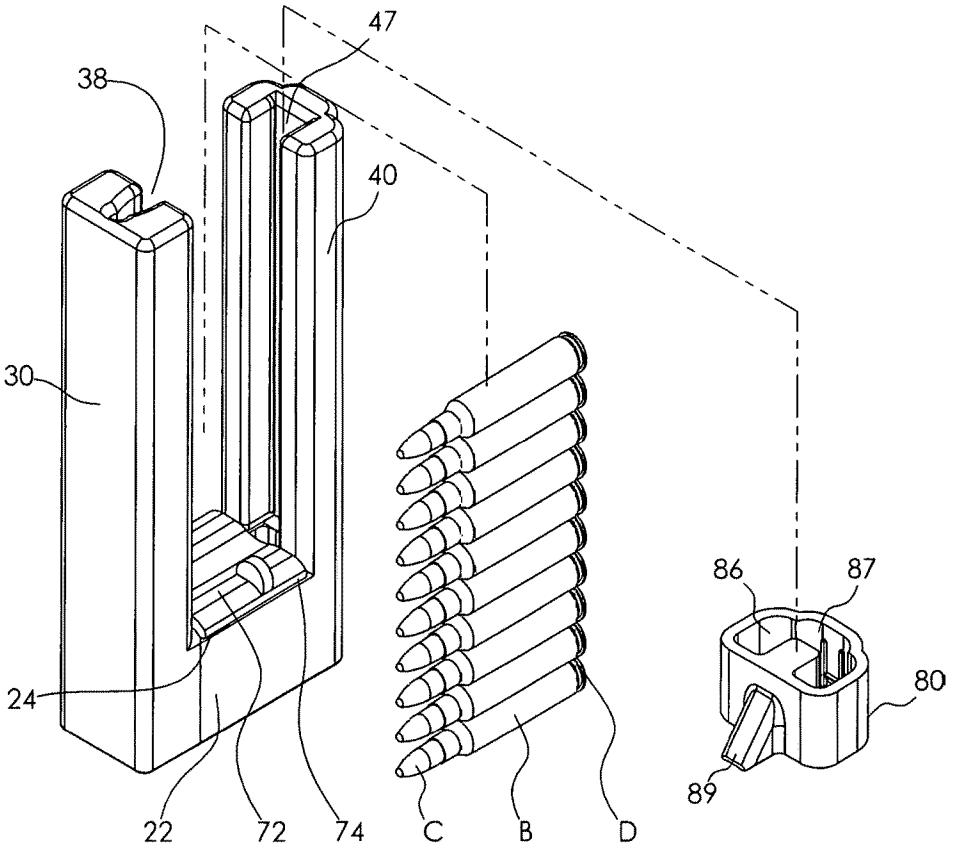
FIG. 8 is a perspective view of the base member, the lock member assembly, a stack of cartridges and the pillar locking sleeve prior to engagement.
Figure 9:
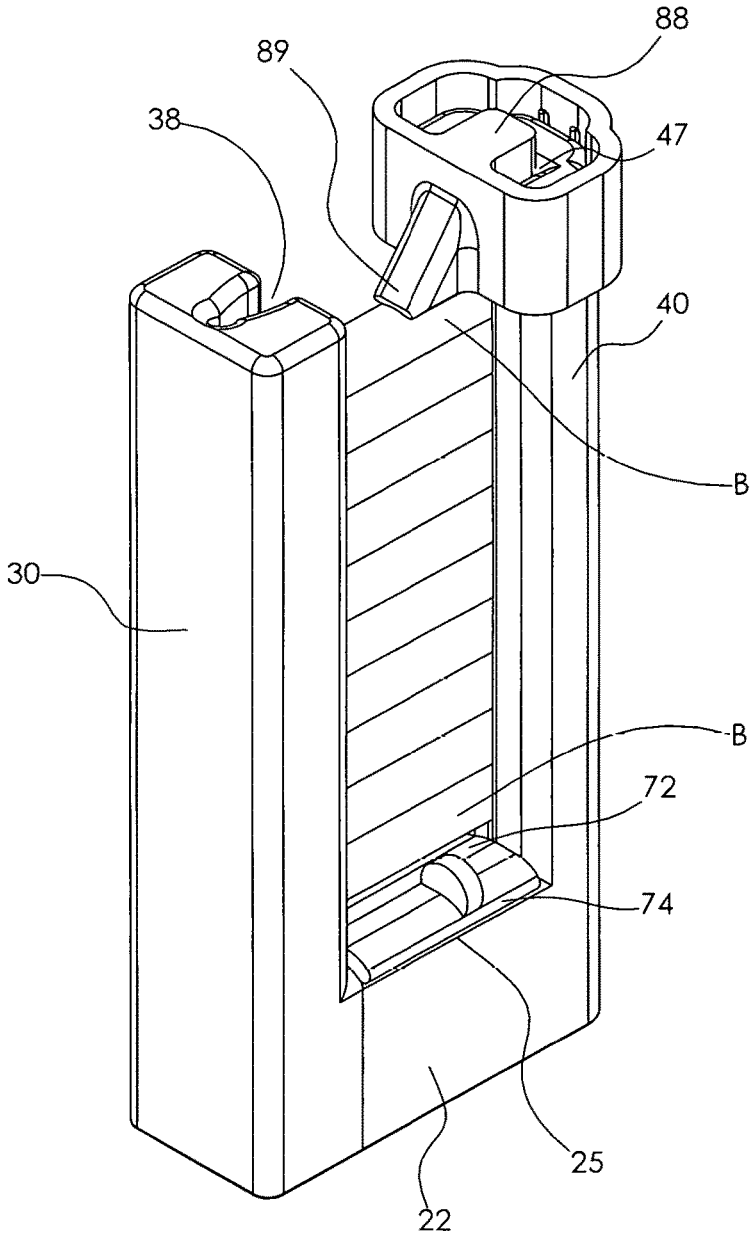
FIG. 9 is a perspective view of the base member, the lock member assembly, a stack of cartridges and the pillar locking sleeve during engagement.
Figure 10:
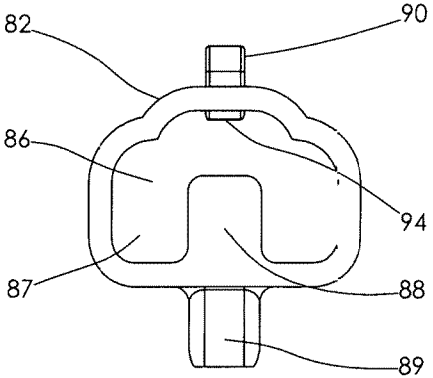
FIG. 10 is a top view of the pillar locking sleeve.
Figure 15:
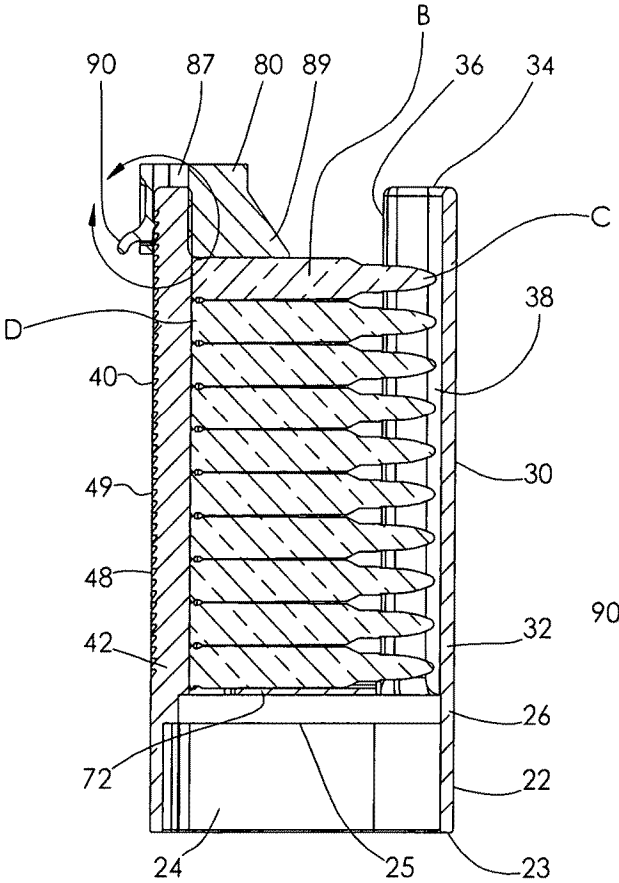
FIG. 15 is a side sectional view of the base member with a stack of cartridges held in place by the pillar locking sleeve against the blocking plate.

A lock member assembly 70 is also provided for an alternative engagement with the rear support pillar 40 to utilize the base member 20 for the storage of cartridges B prior to use for loading an empty magazine, comprising a blocking plate 72 and a pillar locking sleeve 80, as indicated in FIGS. 8-9 and 15. The blocking plate 72 installs over the loading channel 25 of the base member 20, FIGS. 8-9 and 15, to prevent the lowest cartridge within the base member 20 from entry into the loading channel 25, the blocking plate 72 comprising lateral edges 74 which span across the loading channel 25 between the front support pillar 30 and rear support pillar 40. The pillar locking sleeve 80 is a shorter version of the push member 60, also comprising a lower end 84 and an upper end 86, and an inner vertical bore 86 defining an inner slot 87 adapted to slideably engage the rear support pillar 40 of the base member 20, the inner slot 87 extending a linear slot member 88 which slides within the linear slot 47 of the rear support pillar 40 along the length of the inner vertical bore 86 and an inner tab extension 89 extending inward from the lower end 84. In addition, the pillar locking sleeve 80 provides an outer surface 82 further defining a locking means 90 to selectively engage one of the column of evenly spaced lateral indentations 49 defined within the outer surface 48 of the rear support pillar 40 enabling the pillar locking sleeve 80 to be locked at a desired location along the rear support column 40 from the lower end 42 to the terminal upper end 44 of the rear support column 40. This is shown in FIGS. 10-16. In this regard, when the magazine loading device 10 is filled with cartridges B, the pillar locking sleeve 80 is applied to the rear support pillar 40 pressing the inner tab extension 89 of the pillar locking sleeve 80 against the rear of the uppermost cartridge B within the stack, retaining the columns of stacked cartridges B between the blocking plate 72 and the inner tab extension 89, FIG. 15, keeping the cartridges B secured within the base member 20 until such time as the cartridges B are ready to be loaded into an empty magazine A. Prior to loading, the base member 20 is applied to the empty magazine A, the pillar locking sleeve 80 is released from the selected indentation 49 and removed from the rear support pillar 40, the blocking plate 72 is removed and the push member 60 is applied to force the stacked cartridges B into the empty magazine A as disclosed in the manner indicated above.

Figure 12:
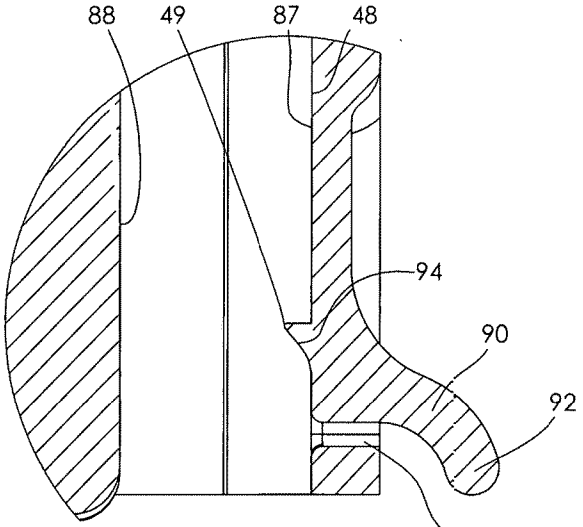
FIG. 12 is a closer view of FIG. 11.
Figure 11:
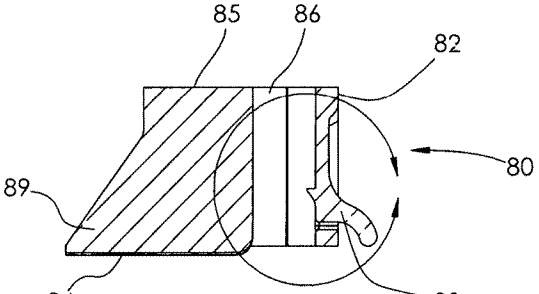
FIG. 11 is a side sectional view of the locking means engaging a lateral indentation.
Figure 14:
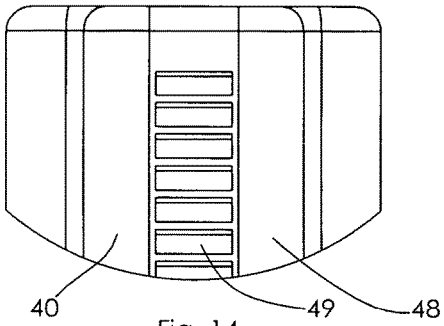
FIG. 14 is a close-up view of the base member as indicated in FIG. 13.
Figure 13:
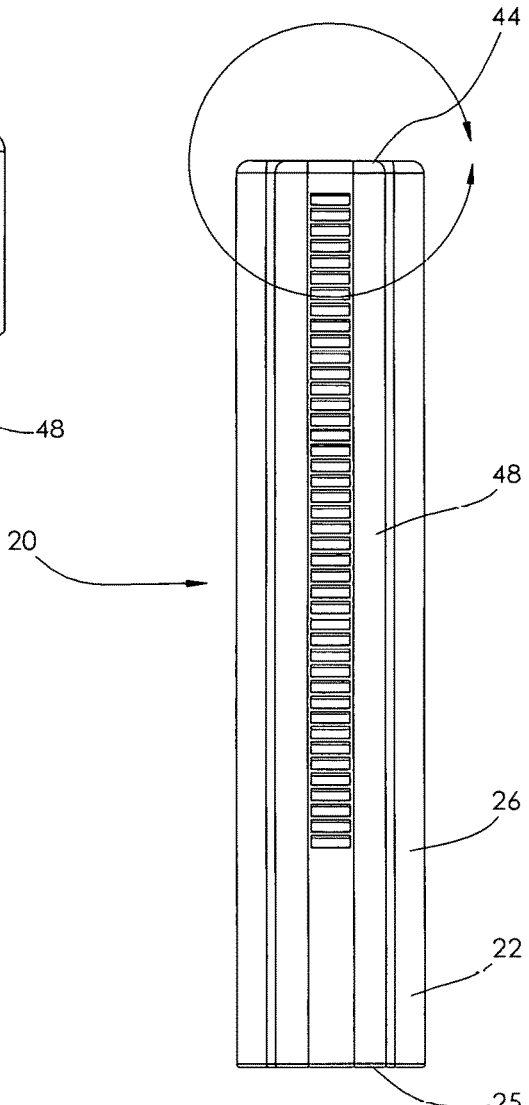
FIG. 13 is a rear view of the base member.
Figure 16:
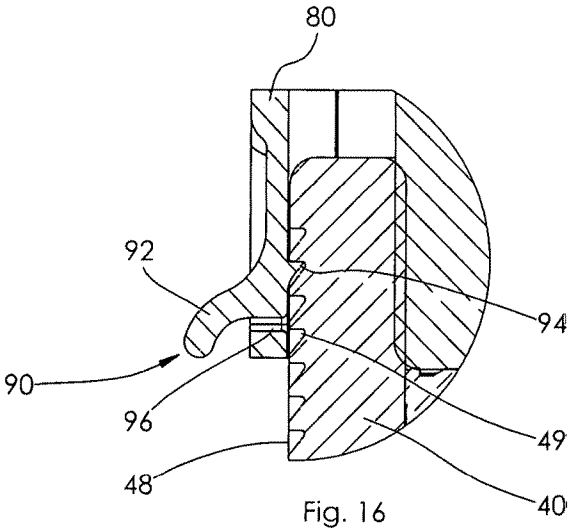
FIG. 16 is an isolated view of FIG. 15 as indicated.

In a preferred embodiment, the locking means 90 is disclosed as shown in FIGS. 11-12 and 16, as a resilient spring lever 92 having an inner pawl 94 directed within a formed slot 96 which is urged inward, with the pawl 94 directed into the inner vertical bore 86 of the pillar locking sleeve 80, the inner pawl 94 bypassing the lateral indentations 49 as the pillar locking sleeve 80 is pushed downward along the rear support member 40, resisting upward movement unless an outward force is applied to the resilient spring lever 92 subsequent to engagement of the inner pawl 94 with the selected lateral indentation 49 to withdraw the inner pawl 94 from upward movement from the selected locked engagement with the indentation 49 until the pillar locking sleeve 80 is removed from the rear support pillar 40 by the release of the resilient spring lever to release the inner pawl 94 from the selected lateral indentation 49.

While the magazine loading device 10 has been particularly shown and described with reference to a preferred embodiment thereof, it will be understood by those skilled in the art that changes in form and detail may be made therein without departing from the spirit and scope of the invention.

What is claimed is:

1. A magazine loading device for quick loading a magazine of a firearm comprising:

a base member defining a frame piece having a lower portion defining a magazine receiver configured to be secured to an upper portion of a specific caliber magazine of a rifle or other firearm, a loading channel formed within said magazine receiver integrating said magazine receiver with an open upper end;

a front support pillar extending upward from said frame piece, said front support pillar further defining a lower end, a terminal upper end, and an interior surface defining an inward tapered slot;

a rear support pillar extending upward from said frame piece, said rear support pillar further defining a lower end, a terminal upper end, an interior surface defining a linear slot and an outer surface providing a plurality of evenly spaced lateral indentations, said rear support pillar and said front support pillar being parallel and extending upward and commonly from said frame piece spanning said magazine receiver and said loading channel with said inward tapered slot and said linear slot spaced apart evenly from said respective lower ends to said terminal upper ends of said front and rear support pillars; and a push member defining an outer surface providing a grip portion, a lower end, an upper end, an inner vertical bore, an inner slot, a linear slot member extending within said inner slot of said inner vertical bore, and an inner tab extension extending outward from said lower end opposite said linear slot member, wherein said rear support pillar is received within said inner vertical bore of said push member with said linear slot member engaging said linear slot of said rear support pillar and said inner tab extension extends inward over said loading slot and wherein a stack of cartridges are placed in a column between said front and rear support pillars with a tip of each said cartridge extending within said inward tapered slot of said front support pillar and said base of each said cartridge extending within said linear slot of said rear support pillar, said push member slideably engaging said rear pillar member with said inner tab extension placed above an uppermost cartridge within said stack of cartridges, said push member being forced downward by said grip portion, with force transferred to said inner tab extension against said base of said uppermost cartridge compelling said stack of cartridges through said loading channel into said magazine engaged within said magazine receiver in a singular downward forced motion.

2. The magazine loading device of claim 1, said base member storing a stack of cartridges prior to loading said magazine utilizing a lock member assembly comprising:

a blocking plate installed over said loading channel of said base member to prevent a lowermost cartridge within said base member from entry into said loading channel, said blocking plate comprising lateral edges spanning across said loading channel between said front support pillar and said rear support pillar; and a pillar locking sleeve defining a lower end, an upper end, an inner vertical bore defining an inner slot adapted to slideably engage said rear support pillar of said base member, said inner slot of said pillar locking sleeve having a linear slot member engaged within said linear slot of said rear support pillar along said inner vertical bore of said pillar locking sleeve, an inner tab extension extending inward from said lower end of said pillar locking sleeve and an outer surface of said pillar locking sleeve further defining a locking means selectively engaging at least one of said column of evenly spaced lateral indentations defined within said outer surface of said rear support pillar providing said pillar locking sleeve to be locked at a desired location along said rear support pillar from said lower end of said rear support pillar to said terminal upper end of said rear support pillar, wherein said pillar locking sleeve is applied to said rear support pillar pressing said inner tab extension of said pillar locking sleeve against said uppermost cartridge within said stack of cartridges, retaining said stack of cartridges between said blocking plate and said inner tab extension of said pillar locking sleeve, keeping said stack of cartridges secured within said base member until such time as the stack of cartridges are to be loaded into said magazine, wherein said blocking plate is removed or otherwise displaced, allowing the passage of the stack of cartridges into said magazine by application of said push member.

3. The magazine loading device of claim 1, said locking means of said pillar locking sleeve further comprising:

a resilient spring lever having an inner pawl directed within a formed slot urging inward, with said pawl directed into said inner vertical bore of said pillar locking sleeve, said inner pawl bypassing said lateral indentations as said pillar locking sleeve is pushed downward along said rear support pillar, resisting upward movement unless an outward force is applied to said resilient spring lever subsequent to engagement of said inner pawl with a selected lateral indentation along said plurality of lateral indentations, retaining said pillar locking sleeve without upward movement, until withdrawal of said inner pawl occurs by pulling on said resilient spring lever to release said inner pawl from the selected lateral indentation allowing said pillar locking sleeve to be removed upward along said rear support pillar.

* * * * *